United States Patent [19]

Ronnevig

[11] 4,109,601

[45] Aug. 29, 1978

[54] VESSEL FOR WORKING UNDER WATER

[75] Inventor: Carl M. Rønnevig, Haugesund, Norway

[73] Assignee: Skipsaksjeselskapet Suderøy, Haugesund, Norway

[21] Appl. No.: 746,541

[22] Filed: Dec. 1, 1976

[30] Foreign Application Priority Data

Dec. 8, 1975 [NO] Norway ..... 754144

[51] Int. Cl.[2] ..... B63G 8/00

[52] U.S. Cl. ..... 114/314; 61/69 R

[58] Field of Search ..... 61/69 R, 69 A; 174/40 CC; 114/16 R, 16 E, 16 G, 16.4, 16.5, 16.6–16.8; 9/8 R, 8 P, 9

[56] References Cited

U.S. PATENT DOCUMENTS

| | | | |
|---|---|---|---|
| 1,795,408 | 3/1931 | O'Rourke | 61/69 A |
| 1,929,168 | 10/1933 | Grieshaber | 61/69 R |
| 2,173,354 | 9/1939 | Cermin | 114/16.4 |
| 2,292,140 | 8/1942 | Lofgren | 174/40 CC |
| 3,527,184 | 9/1970 | McCarty | 114/16 R |
| 3,757,725 | 9/1973 | Horn | 114/16 R |
| 3,831,387 | 8/1974 | Rolleman | 114/16.8 |
| 3,990,377 | 11/1976 | Marquinez | 114/16 R |

*Primary Examiner*—Trygve M. Blix
*Assistant Examiner*—D. W. Keen
*Attorney, Agent, or Firm*—Emrich, Root, O'Keeffe & Lee

[57] ABSTRACT

A vessel for working under water comprising a substantially spherical residence chamber with an atmospheric pressure therein and accommodating necessary monitoring apparatus for controlling working tools and devices arranged on the outside of the residence chamber. The working tools and devices are mounted on a service section to which the residence chamber is detachably affixed by a coupling apparatus actuated from the residence chamber. In case the service section with its working tools and devices gets hooked or wedged during the underwater operation the residence chamber can be released from the service section and allowed to rise to the surface separated from the service section. The working tools and devices of the service section are so designed that in any working positions they do not render the escape path of the residence chamber blocked.

7 Claims, 5 Drawing Figures

VESSEL FOR WORKING UNDER WATER

BACKGROUND OF THE INVENTION

The present invention relates to a vessel for working under water.

Sub-surface vessels which are used for observation and carrying out certain tasks under water are previously known. At depths larger than 300 m such vessels are required, since conventional diving techniques at such depths entail very time-comsuming readjustment processes for the divers and the duration of each diving operation becomes very short.

Thus, completely remote-controlled vessels for monitoring and carrying out of minor tasks under water are known. Such vessels can as a rule only be used for remote observation of certain areas and collection of samples of sea water at the depth position of the vessel or in some cases for collection of samples from the ocean bed. However, it is very difficult by means of such remote-controlled vessels to carry out, e.g., repair and installation work, since even advanced remote-controlled mechanisms cannot compensate the human sense of locality on the site. Apart from the fact that such work is very difficult to accomplish from the carrier vessel, the equipment required to carry out a remote-controlled working operation is very complicated and expensive.

Thus, there are also known sub-surface vessels, e.g., of the mini-submarine type, in which the crew is accommodated in a chamber with an atmospheric pressure therein and from this chamber controls various devices mounted on the outside of the vessel. The sojourn under water can then be made relatively comfortable for the crew compared to diving work, and it may last for periods comparable to those of ordinary sub-marine operations. Further, with such vessels the advantage is obtained that the operator can directly observe the work which is carried out and on the spot decide whether it is satisfactory.

The present invention thus relates to a vessel for working under water of the type comprising a residence chamber with an atmospheric pressure therein and accommodating the required control means for controlling devices and tools on the outside. Previously known vessels of this type are, however, encumbered with the disadvantage that a laborious and time-consuming work is required to detach the vessel if parts of the vessel or the exterior devices thereof should become hooked to the bottom or other equipment on the underwater site.

From U.S. Pat. No. 3,369,368 there is known a diving structure comprising a pair of spherical units rigidly interconnected by a common hatchway communicating the interiors thereof with each other. The structure is not connected to a service section carrying working tools and devices and primarily serves as a pressure regulating means for divers.

U.S. Pat. No. 3,527,184 teaches a manned observatory adapted for oceanographic and ocean engineering research, said observatory not being able to carry out any working operations under water.

In GB-PS No. 1,159,060 there is described a living quarter for underwater works. It is true that the living quarter can be connected to a spherical diver's bell, but the living quarter is used only as an observation chamber and no working tools and devices are arranged at the outside.

From GB-PS No. 1,367,837 there is known a spherically shaped diver's bell adapted to be attached to and released from a submerged base member. The diver's bell is used for the transportation of personnel from the surface to the base member which rests permanently at the ocean bed.

A spherical diving bell is also known from GB-PS No. 1,363,798, said bell being centered and cradled in a box-like frame of a submersible working unit by a circular array of elements consisting of utility gas bottles, buoyancy elements and cushions. Since the diving bell is encircled by the array of elements and cradled in the box-like frame, the diving bell cannot easily be detached from the submersible unit, let alone when this is operating under water. Such a sub-surface vessel will therefore constitute a trap for the persons in the diving bell if said vessel should be hooked or wedged during underwater operation. The escape path of the diving bell is blocked and only another sub-surface vessel having necessary complicated rescue means would be able to release the hooked or wedged working unit or the diving bell.

SUMMARY OF THE INVENTION

The object of the present invention is to provide a direction for the construction of a vessel of the above-mentioned type which is not encumbered with the mentioned disadvantages. The sub-surface vessel according to the invention is characterized in that the residence chamber is connected by a detachable coupling means actuated from the residence chamber to a service section carrying the working tools and devices so as to allow detachment of the residence chamber from the service section in case the latter gets hooked or wedged during the underwater operation, and that the working tools and devices of the service section are so designed that in any working position they do not render the escape path of the residence chamber blocked. Hereby a sub-surface vessel is achieved which minimizes the risk of the residence chamber itself of becoming hooked to the bottom or to equipment on the underwater site. The substantially spherical shape of the residence chamber or section should, of course, have as smooth surfaces as possible, so that the residence chamber when released from the service section can escape from the site without the risk of getting hooked to underwater equipment.

In a vessel designed according to the present invention the further advantage is achieved that the same residence chamber may easily be mounted on other service sections of various sizes and configurations according to the work to be accomplished. Due to the fact that the service section can easily be detached from the residence chamber, also the service and maintenance of the service section is facilitated, and alterations and conversions of the individual sections can be more easily carried out in the absence of the residence chamber.

In a preferred embodiment of the invention the coupling means may comprise a pressure-proof coupling chamber in which the pressure during normal operation is atmospheric, and which is equipped with valve means which at conditions calling for a detachment of the coupling serve to equalize the difference in pressure between the coupling chamber and the surrounding medium.

By utilizing the pressure difference between the coupling chamber and the surrounding medium it is possible during normal operation to improve the sealing effect of the coupling chamber, pressure equalizing actions not being performed before the detachment operation to facilitate the separation of the residence chamber from the service section.

Suitably, the coupling chamber may consist of a pipe-shaped connecting piece protruding from the bottom of the residence chamber, said connecting piece in the area of the residence chamber encircling a first lead-in wall portion thereof, and in the area of the service section being sealingly attached thereto and encircling a second lead-in wall portion thereof. A rotatable coupling shaft may pass sealingly through the lead-in wall portion of the residence chamber. At one end which protrudes into the residence chamber, the shaft may have a head onto which may be fitted a tool serving to rotate the shaft. At the other end the rotatable shaft may be provided with threads engaging corresponding threads formed in the second lead-in wall portion of the service section.

Another feature of the vessel according to the invention is that the power equipment which serves to operate the service section, is positioned in one or more closed containers filled with a fluid such as oil, and that sensors for sensing the external pressure are provided in the containers, said sensors influencing and controlling pressure generating means which serve to maintain the pressure in the containers at the same or at a higher level than the exterior pressure. Thereby sea water is prevented from penetrating into the containers and damaging the power equipment if leakage of the containers should occur. Upon leakage of the fluid carrying pipes connected between the power source and the driving means, the dynamic fluid will seep out only into the surrounding static fluid without leaking out of the service section.

The invention will in the following be described in more detail, reference being had to the drawing.

DETAILED DESCRIPTION OF THE PREFERRED EMBODIMENT

Figure 1:
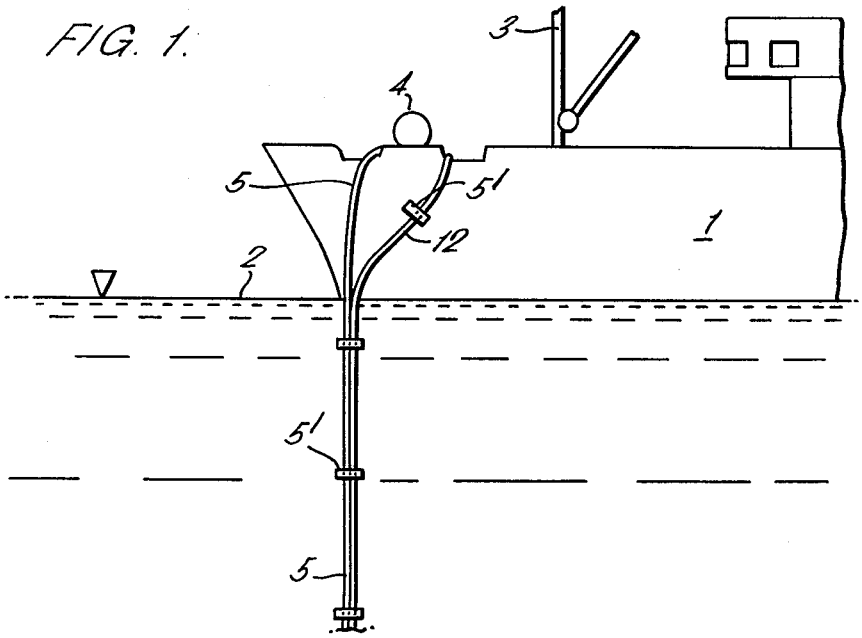
FIG. 1 is a sketch showing a system for working under water and including the sub-surface vessel according to the invention.
Figure 1:
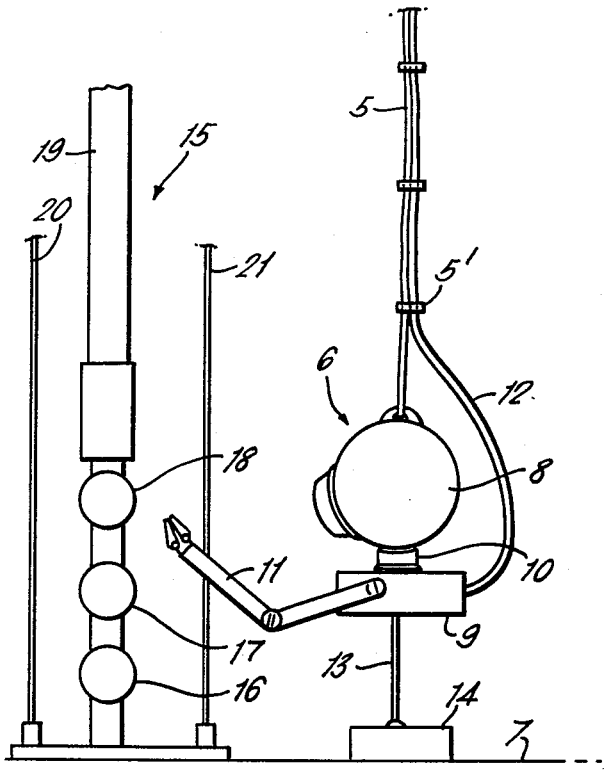

In FIG. 1 a carrier vessel 1 is shown located at the surface 2 and being provided with hoisting gear 3 and winches 4. Via a wire 5 the carrier vessel 1 is connected to a sub-surface vessel 6 positioned adjacent the sea bed 7 and mainly consisting of an upper spherical residence section or chamber 8 and a lower service section 9. Between the residence section 8 and the service section 9 a releasable coupling 10 is provided, and the service section 9 in addition to power sources (not shown) and power transmission mechanisms carries tools 11 which through the transmission mechanisms may be controlled by the crew staying in the residence section 8.

The supply of primary power to the service section 9 and the communication between the residence section and the carrier vessel takes place through an electric cable 12 attached to the wire 5 by fasteners 5' which will be discussed in detail with reference to FIG. 5.

In the service section 9 there are provided winches (not shown) which may be controlled from the residence section 8, and which serve to hoist and lower a weight 14 by means of a second wire 13. The weight serves as an anchor for the sub-surface vessel 6 when working close to the sea bed 7.

In the left part of FIG. 1, 15 is the general designation of the equipment which is, e.g., provided in a well area, e.g., on the wellhead of underwater wells for controlling the production thereof. The equipment may comprise flow regulators which usually include a number of special valves, e.g., as indicated at 16, 17 and 18, controlling the effective flow of oil from the well through a flow pipe 19 to some sort of a storage arrangement at the surface of the sea. In FIG. 1, 20 and 21 further designate guiding wires for equipment to be lowered to the area of the well bore, since an inspection and carrying out of maintenance work is required both during the installation period and during the operation of the wellhead to ensure, as far as possible, an un-interrupted operation of the oil well.

Figure 2:
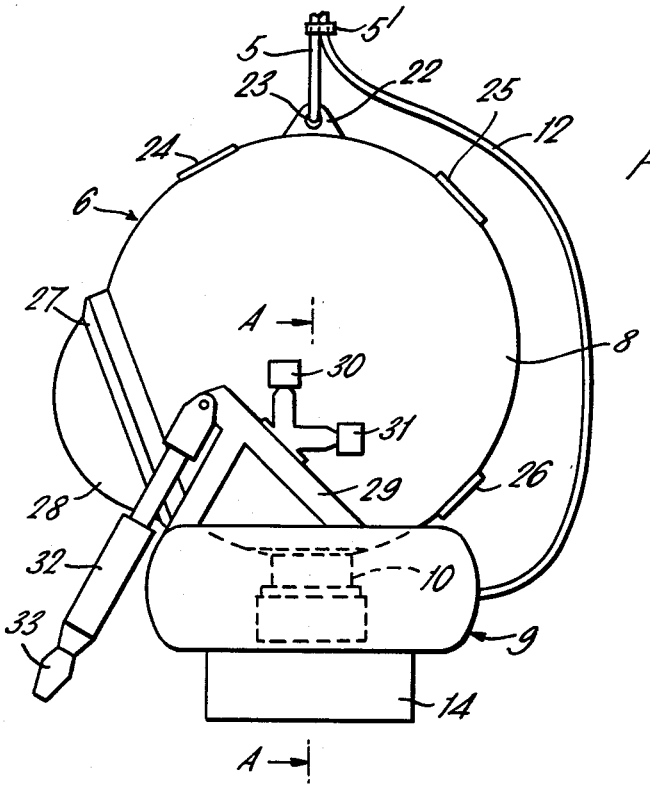
FIG. 2 is a side-view on a larger scale of an embodiment of the sub-surface vessel according to the invention.
Figure 3:
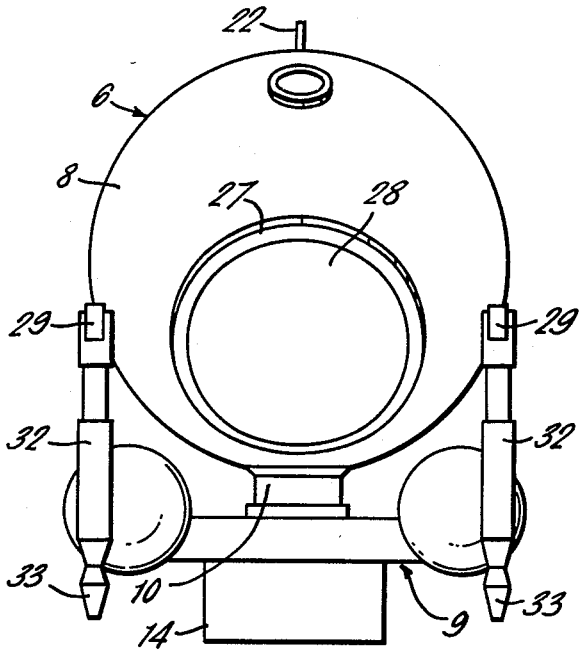
FIG. 3 is a front view of the vessel of FIG. 2.

FIGS. 2 and 3 are a side-view and a front view, respectively, on a larger scale of a preferred embodiment of the sub-surface vessel 6 according to the invention. Also here 8 designates an approximately spherical residence chamber or section which by a detachable coupling 10 is connected to the service-section, which also in these Figures is generally designated by 9. On the service section 9 there is, as before, provided a weight 14 which via the wire 13 (FIG. 1) can serve as an anchor by being lowered from the vessel in its underwater position.

At the top of the residence chamber there is provided an attachment lug 22 having a hole 23 through which the wire 5 may be threaded to be attached to the lug 22. The lug may be detachably affixed to the residence chamber, the detachment being accomplished from the residence chamber by appropriate means, not shown. In FIGS. 2 and 3, 24, 25 and 26 designate inspection hatches provided at appropriate positions in the residence section. 27 designates a larger inspection hatch which is covered by a concave plate 26 of transparent material. Suitably the hatch 27 also serves as an entrance to the residence chamber 8, and the hatch 27 may therefore be equipped with appropriate locking means (not shown) retaining the hatch in position when the vessel is in use.

On the service section 9 there are provided brackets 29 carrying reversible thrusters 30 and 31 for transversal and vertical movement of the vessel 6. It is to be understood that the number of thrusters and the manner in which they are mounted are so chosen as to make it possible to move the vessel 6 in any direction by a combination of the effects of the individual thrusters.

On the brackets 29 there are provided working arms 32 which are preferably hydraulic and which may be raised and lowered and extended to the desired position by being controlled from the residence chamber 8. The free ends 33 of the working arms 32 may be provided with a tool appropriate for the working operation to be carried out under water. As described in connection with FIG. 1, power is supplied to the service section from the carrier vessel 1 via the electric cable 12 which is connected to the service section 9 at a suitable place. Thus, the service section 9 accommodates not only the converter means required for converting electrical energy to hydraulic energy, but also the necessary power transmission and servo mechanisms operating the hydraulic working arms 32, the thrusters 30 and 31 and the hoisting apparatus for the weight 14.

Figure 4:
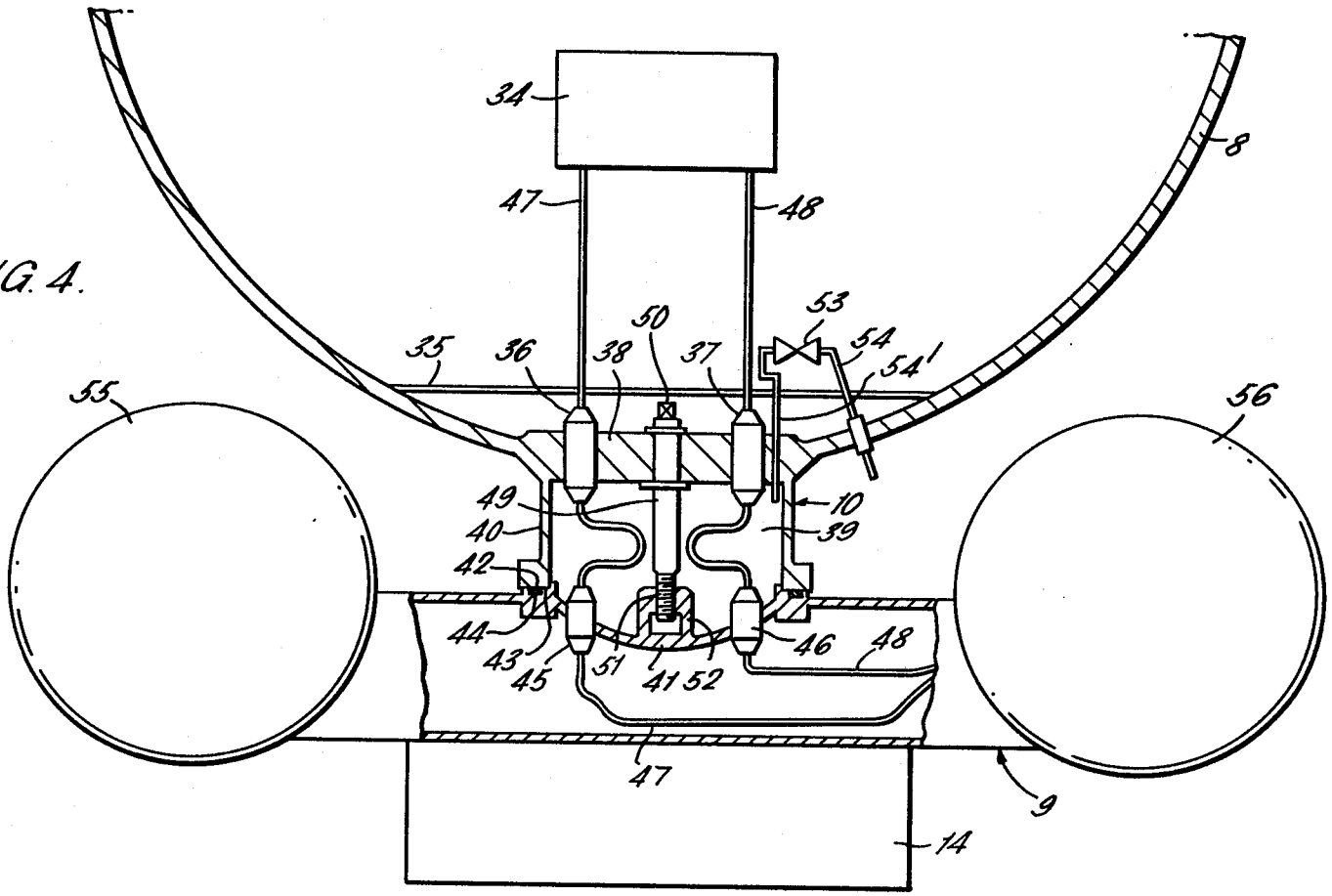
FIG. 4 is a fragmentary sectional view on a larger scale taken along line A—A in FIG. 2.

As indicated in FIG. 4, a control desk 34 is provided in the residence chamber 8, from which desk the necessary operations of the working arms 32 can be controlled. From the control desk 34 a manoeuvring of the vessel 6 by the thrusters 30 and 31 and a lowering and hoisting of the weight 14 can also be accomplished.

In FIG. 4, 35 designates the floor of the residence chamber 8, and 36 and 37 designates electric lead-ins of the plug and socket type. These lead-ins pass through a lead-in wall portion 38 in the bottom of the residence chamber 8. The coupling 10 is in this case designed as a pressure proof coupling chamber 39 consisting of a pipe connecting piece 40 protruding from the bottom of the residence chamber 8 and in the area thereof encircling the lead-in wall portion 38. The pipe connecting piece 40 engages a lead-in wall portion 41 of the service section 9, an annular gasket 44 being provided between the engagement surfaces 42 and 43 of the connecting piece 40 and lead-in wall portion 41, respectively. In the lead-in wall portion 41 of the service section 9 there are also provided lead-ins 45 and 46 of the plug and socket type, a power cable 47 passing through the lead-ins 45 and 36 and a communication cable 48 passing through the lead-ins 46 and 37. These cables in turn form part of the cable 12 connected to the carrier vessel 1 at the surface. A rotatable coupling shaft 49 sealingly passes through the lead-in wall portion 38 of the coupling chamber. At the end protruding into the residence chamber 8 this shaft is provided with a polygonal head 50 onto which may be fitted an appropriate tool for rotating the shaft 49. At the other end the coupling shaft 49 is provided with male threads 51 engaging corresponding threads formed in a coupling element 52 of the lead-in wall portion 41 of the service section 9.

The residence section 8 and the service section 9 are assmebled ashore, the coupling 10 being pressure proof due to the coupling shaft 49 and the gasket 42. In submerged position the pressure difference between the coupling chamber 10 and the surrounding medium will enhance the sealing effect between the residence chamber 8 and the service section 9. In the residence chamber 8 there is also provided a valve 53 inserted between a first pipe-line 54 which passes from the outside into the residence chamber 8, and a second pipe-line 54' which passes from the residence chamber 8 downwards into the pressure proof coupling chamber 10 which during normal operation retains atmospheric pressure. Upon opening of the valve 53 the pressure between the surrounding medium and the coupling chamber 10 will be equalized, so that it will be a simple matter to detach the residence chamber 8 from the service section 9 by rotating the coupling shaft 49.

The residence chamber 8 should be so designed that during operation with a complete crew and necessary equipment a positive buoyancy is obtained. The shell which constitutes the residence chamber should therefore be as thin as possible without sacrifying the security aspects of the vessel structure. If desired adjustable buoyancy tanks (not shown) may be provided in the residence chamber 8. Also on the service section 9 there are provided buoyancy bodies. In FIGS. 2–4 for example two buoyancy tanks 55 and 56 may be arranged on the service section, but it is to be understood that due to space considerations parts of the tanks 55 and 56 may accommodate the equipment necessary for the operation of the service section 9 and the devices mounted thereon. However, it is to be understood that for reasons of security it is advantageous when the residence chamber has a positive buoyancy during operation, whereas the service section 9 has a negative buoyancy, the two buoyancies approximately balancing each other under normal condition when the weight is lowered onto the sea bed. Under normal working conditions the vessel 6 may then be easily manoeuvred by the thrusters 30 and 31, and with the residence chamber 8 detached it is ensured that the positive buoyancy of the residence chamber 8 will assist in the floating thereof to the surface. When the residence chamber 8 is released from the service section 9 the cables 47 and 48 are disconnected at the sockets either in the lead-ins 45 and 46, respectively, of the service section 9 or in the lead-ins 36 and 37, respectively, in the residence chamber 8.

As mentioned above the power equipment necessary for the operation of the service section may be arranged in the tanks 55 and 56. The parts of the tanks accommodating the power equipment are preferably filled with a fluid, e.g., oil, which by pressure generating means (not shown) is maintained at a pressure level which does not go below the external underwater pressure. Suitable pressure sensors sensing the external pressure act on the pressure generating means, and the pressure sensors are conveniently set so as to maintain in the containers a pressure somewhat higher than the external pressure. It is to be understood that the fluid carrying pipes connected between the hydraulic power source and the various driving means of the service section, as well as the power source and the electric motor giving the necessary power to said power source are provided in a pressurized oil bath. Thus, a leakage of the fluid pipes results in that fluid seeps out into the surrounding static fluid without leaking into the service section itself. If a leakage should occur in the tank walls penetration of sea water causing damage to the power equipment is avoided.

As indicated in FIGS. 1 and 2 the wire 5 is attached to the residence chamber 8 and the electric power and communication cable 12 is attached to the service-section 9. If the service section is hooked or wedged it is required that the residence chamber 8 can be separated from the service section 9 by uncoupling even if the cable 12 is still attached to the latter section. For this purpose the fasteners 5' holding the cable 12 to the wire 5 are conveniently designed in the manner indicated in FIG. 5.

Figure 5:
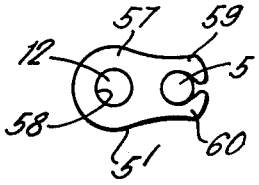
FIG. 5 is a top view on a larger scale of a fastener for an electric cable.

The fastener 5' in FIG. 5 consists of a main portion 57 having a hole 58 for threading the fastener onto the cable 12. The fastener 5' has laterally protruding portions consisting of two half-way opened jaw portions 59 and 60 which partly surround the wire 5. The fastener 5' is made of a resilient material, e.g., rubber, and the jaw portions 59 and 60 are designed so as resiliently to fit around the wire 5 under normal conditions while being easily expanded to release the wire 5 from the cable 12 attached to the service section 9 when the residence chamber 8 has been detached from the service section 9 and float towards the surface. It is to be understood that during normal operation when the vessel 6 is at the bottom or adjacent thereto with the weight 14 lowered, care must be taken that the wire 5 is appropriately tensioned so as to avoid the hooking thereof onto equipment at the site. This may for example be effected by means of appropriate sensing means which are read either at the carrier vessel or in the residence chamber. It is to be understood that if also the wire 5 should be hooked, it may be released from the residence chamber 8 by detaching the attachment lug 22 at the top of the residence chamber 8.

The present invention may, of course, be reduced to practice in many other ways than the one illustrated in the drawing. Thus, for example the weight 14 may be omitted if the vessel is to operate in an underwater area which is far above the sea bottom and does not readily permit an anchoring of the vessel. Further, the coupling 10 does, of course, not have to be pressure proof. The structure may then be approximately as described above, and a quicker detachment can be obtained, the time delay associated with the equalization of any pressure difference being avoided.

The residence chamber may, of course, deviate from the substantially spherical shape, but it should still be observed that it retains an outer surface as smooth as possible which will not constitute an obstacle when the residence chamber escapes from the service section. Further, it is to be understood that in the construction of the vessel according to the invention due regard must be given to the positions which the working tools may occupy since these positions must not interfere with the rising of the residence chamber when it is necessary to detach it and bring it to the surface separated from the service section. Further, it is to be understood that in the residence chamber 8 there is provided necessary equipment which makes the sojourn herein for a shorter or longer period independent of the power supply and the communication via the cable 12.

By detachably connecting the residence chamber to the service section, not only the advantage of permitting the residence chamber to escape from the service section if the latter becomes hooked under water, but also the advantage that the residence chamber may easily be used in connection with other service sections equipped with other types of working tools, are obtained. Thus, by replacing one service section with another, various working operations may be accomplished with the same residence chamber. Conveniently, the control systems for controlling the drive means of the service section may be composed of modules for easy connection to the control desk in the residence chamber.

What I claim is:

1. In a vessel for working under water at any level from the lower water bottom to the upper water surface, the vessel having a service section carrying working tool devices thereon and propulsion means, and a residence chamber detachably mounted on said service section, the residence chamber having an atmospheric pressure therein and including monitoring means therein for controlling the working tool devices; the improvement comprising that the residence chamber has a substantially spherical shape with an outer smooth surface free from protruding elements, the residence chamber being connected to a carrier vessel on the water surface thereof by a hoisting wire, whereby in case the protruding working devices of the service section are hooked or wedged during an underwater operation, the spherical smooth residence chamber can be detached from the service section and hoisted to the carrier vessel, with said working tool devices of the service section being so mounted thereon to permit detachment of the residence chamber and provide an escape path for the substantially spherical residence chamber during the hoisting operation and wherein the vessel includes controllable buoyancy means operatively connected to the service section to predeterminely control the level of the service section and the residence chamber from the lower water bottom to the upper water surface.

2. The vessel in accordance with claim 1 wherein a coupling means detachably mounts the residence chamber to the service section, said coupling means including a pressure proof coupling chamber extending from the bottom of the residence chamber and operatively connected to the water by valve means, said pressure proof coupling chamber having an atmospheric pressure during normal operation and wherein said valve means operates to equalize the pressure difference between said coupling chamber and the surrounding medium to permit detachment of the residence chamber from the service section.

3. The vessel in accordance with claim 2 wherein said coupling chamber includes a pipe connecting member extending from the bottom surface of the residence chamber, with the bottom surface of the residence chamber within the pipe connecting member defining a first lead-in wall portion and with the upper surface of the service section defining a second lead-in wall portion, with said pipe connecting member being adapted to engage and sealingly attach to said second lead-in wall portion to join the residence chamber to the service section.

4. The vessel in accordance with claim 1 further including power conduit means detachably secured to said hoisting wire, with said power conduit means extending from said carrier vessel to the service section to power the working tool devices.

5. The vessel in accordance with claim 4 wherein said power conduit means is detachably secured by fastening means to said hoisting wire, said fastening means includes jaw portions thereon partially engaging said wire and adapted to receive and hold said power conduit means and said hoisting wire to thereby permit detachment of the fastening means and said power conduit means from said hoisting wire when the residence chamber is detached and separated from the service section.

6. In a vessel for working under water at any level from the lower water bottom to the upper water surface, the vessel having a service section carrying working tool devices thereon and propulsion means, and a residence chamber detachably mounted on the service section, the residence chamber having an atmospheric pressure therein and including monitor means therein for controlling the working tool devices; the improvement wherein:

the residence chamber has a substantially spherical shape with an outer smooth surface free from protruding elements, the residence chamber being connected to a carrier vessel on the water surface thereof by a hoisting wire, coupling means detachably mounting the residence chamber to the service section, said coupling means including a pressure-proof coupling chamber having a pipe connecting member extending from the bottom surface of the residence chamber and operatively connected to the surrounding water by valve means, said pressure-proof coupling chamber having an atmospheric pressure during normal operation and wherein said valve means operates to equalize the pressure difference between said coupling chamber and the surrounding water to permit detachment of the residence chamber from the service section, and said bottom surface of the residence chamber within the pipe connecting member defining a first lead-in wall portion and the upper surface of the service section defining a second lead-in wall portion having connector means mounted therein and adapted to engage and hold a rotatable coupling shaft sealingly extending through and from said first lead-in wall portion, said shaft being engageable with the connector means to sealingly and detachably secure the residence chamber to the service section whereby in the case the protruding working elements of the service section are hooked or wedged during an underwater operation, the spherical smooth residence chamber is detachably released from the service section, and hoisted to the carrier vessel with the working tool devices of the service section being so mounted thereon to permit detachment of the residence chamber and to provide an escape path for the substantially spherical residence chamber during the hoisting operation.

7. In a vessel for working under water at any level from the lower water bottom to the upper water surface, the vessel having a service section carrying working tool devices thereon and propulsion means, and a residence chamber detachably mounted on the service section, the residence chamber having an atmospheric pressure therein and including monitor means therein for controlling the working tool devices; the improvement wherein:

the residence chamber has a substantially spherical shape with an outer smooth surface free from protruding elements, the residence chamber being connected to a carrier vessel on the water surface thereof by a hoisting wire, coupling means detachably mounting the residence chamber to the service section, said coupling means including a pressure-proof coupling chamber having a pipe connecting member extending from the bottom surface of the residence chamber and operatively connected to the surrounding water by valve means, said pressure-proof coupling chamber having an atmospheric pressure during normal operation and wherein said valve means operates to equalize the pressure difference between said coupling chamber and the surrounding water to permit detachment of the residence chamber from the service section, and said bottom surface of the residence chamber within the pipe connecting member defining a first lead-in wall portion and the upper surface of the service section defining a second lead-in wall portion, each of said first and second lead-in includes control means which are matingly engageable when said pipe connecting member engages and is sealingly attached to said second lead-in wall portion to permit control of the service section from the residence chamber, and whereby in the case the protruding working elements of the service section are hooked or wedged during an underwater operation, the spherical smooth residence chamber is detachable released from the service section, and hoisted to the carrier vessel with the working tool devices of the service section being so mounted thereon to permit detachment of the residence chamber and to provide an escape path for the substantially spherical residence chamber during the hoisting operation.

* * * * *